US008517865B2

(12) United States Patent
Schumann

(10) Patent No.: US 8,517,865 B2
(45) Date of Patent: Aug. 27, 2013

(54) NO ZONE PITCHER'S PRACTICE APPARATUS

(76) Inventor: Jacob E. Schumann, Pembrook Pines, FL (US)

( * ) Notice: Subject to any disclaimer, the term of this patent is extended or adjusted under 35 U.S.C. 154(b) by 0 days.

(21) Appl. No.: 13/246,177

(22) Filed: Sep. 27, 2011

(65) Prior Publication Data

US 2012/0172156 A1 Jul. 5, 2012

Related U.S. Application Data

(60) Provisional application No. 61/460,378, filed on Dec. 30, 2010.

(51) Int. Cl.
*A63B 69/00* (2006.01)

(52) U.S. Cl.
USPC ..... 473/454; 473/422

(58) Field of Classification Search
USPC ..... 473/422, 451, 454, 455, 456, 417, 473/430; D21/780
See application file for complete search history.

(56) References Cited

U.S. PATENT DOCUMENTS 1,592,005 A * 7/1926 Rovane ..... 473/454
3,157,399 A * 11/1964 Gaudet ..... 473/455
3,312,467 A * 4/1967 Dawson ..... 473/454
3,997,158 A * 12/1976 Britton ..... 473/454
4,473,227 A 9/1984 Klaus
4,497,485 A 2/1985 Macosko
4,657,250 A * 4/1987 Newland et al. ..... 473/432
4,768,784 A * 9/1988 Wilson ..... 473/454
4,783,070 A * 11/1988 Bauer et al. ..... 473/453
4,955,607 A * 9/1990 Maye ..... 473/456
4,978,121 A * 12/1990 Larkey ..... 473/454
5,083,774 A 1/1992 Yalvac
5,333,856 A 8/1994 Gery
5,348,291 A 9/1994 Scully
5,511,775 A * 4/1996 Parks ..... 473/454
5,516,115 A 5/1996 McLain
5,553,847 A * 9/1996 Surrency ..... 473/453
5,573,239 A * 11/1996 Ryker et al. ..... 473/436
5,599,017 A * 2/1997 Bixler et al. ..... 473/436
5,704,855 A 1/1998 Kellogg, Jr.
5,803,841 A 9/1998 Daskoski
6,458,048 B1 * 10/2002 McGrath ..... 473/421
6,663,513 B2 12/2003 Howard
6,695,725 B1 2/2004 Burns, Jr.
7,175,550 B1 2/2007 Bellah, Jr. et al.
7,220,194 B1 * 5/2007 Laiacona et al. ..... 473/454
7,399,241 B1 * 7/2008 Thomas, Sr. ..... 473/455
7,601,081 B1 * 10/2009 Larkey ..... 473/454

(Continued)

OTHER PUBLICATIONS

Appelman, D., "Generalities in Pitch Location", R. Lederer & Friends[online]; 2006 [retrieved on Sep. 6, 2011]; <URL:http://baseballanalysts.com/archives/2006/11/generalities_in.php>.

(Continued)

*Primary Examiner* — Mitra Aryanpour
(74) *Attorney, Agent, or Firm* — M. Susan Spiering

(57) ABSTRACT

The present invention relates to a softball/baseball pitcher's pitching practice device, and to a method for using the device. It is a simple and inexpensive pitching practice device useful for indicating the boundaries of a typical strike zone to softball and baseball pitchers. More particularly, this invention relates to a pitching practice device having a strike zone indicator that can be conveniently adjusted to simulate the strike zones of batters of various heights.

10 Claims, 3 Drawing Sheets

(56) References Cited

U.S. PATENT DOCUMENTS

| | | | | |
|---|---|---|---|---|
| 7,651,417 | B1 * | 1/2010 | Sims | 473/454 |
| 7,762,912 | B2 * | 7/2010 | Lewis | 473/454 |
| 7,819,763 | B2 * | 10/2010 | Campbell et al. | 473/453 |
| 7,955,196 | B2 * | 6/2011 | Constant | 473/451 |
| 7,976,413 | B2 * | 7/2011 | Meltzer et al. | 473/454 |
| 8,113,968 | B2 * | 2/2012 | Fittler | 473/446 |
| 2002/0132685 | A1 * | 9/2002 | Fusco | 473/454 |
| 2003/0220177 | A1 * | 11/2003 | Orlando | 482/148 |
| 2004/0132557 | A1 * | 7/2004 | Broglio et al. | 473/422 |
| 2005/0255945 | A1 * | 11/2005 | Green | 473/417 |
| 2006/0089212 | A1 * | 4/2006 | Marchel | 473/422 |
| 2006/0148597 | A1 * | 7/2006 | Pope et al. | 473/453 |
| 2010/0298958 | A1 | 11/2010 | Connelly | |

OTHER PUBLICATIONS

Schutt Sports 2012 Softball Baseball Catalog [online]; 2011; [retrieved on Aug. 25, 2011]; <URL:http://www.schuttsports.com/aspx/catalog/catalog.aspx >.

Home Run Sports 2008 Baseball/Softball Catalogue[online];2008;[retrieved on Sep. 6, 2011]; <URL:http://www.homerunsports.com/catalogues/08BBSB/PDF/Complete08BBSB.pdf>.

* cited by examiner

NO ZONE PITCHER'S PRACTICE APPARATUS

CLAIM FOR PRIORITY

This application is based on U.S. Provisional Patent Application No. 61/460,378, entitled The No Zone, A Pitcher's Practice Apparatus, fled Dec. 30, 2010, the priority of which is hereby claimed and the disclosure of which is incorporated herein by reference.

BACKGROUND

1. Field of Invention

The present invention relates to a softball/baseball pitcher's pitching practice apparatus. The apparatus of the invention is designed to give instant visual feed back to any user of the device to avoid the "danger" zone of the opposing hitters they will be facing.

2. Description of the Prior Art

Numerous patents have been issued for pitching practice devices that comprise a target at which a pitcher can "aim" when delivering a pitched ball. Those and other conventional devices often include a net or other enclosure that is adapted to receive and capture a pitched ball where no catcher is present. Still other prior art devices incorporate mechanical means with a power supply, vertical members and cross-arms, some of which are made adjustable through the use of clamps, set screws, bolts, pins, or fabric barriers to vary the size of the target area. Motorized devices by their nature are complex devices and often expensive, and not readily available to many consumers.

Patents believed to disclose pitching practice devices having a net or enclosure typical of those found in the prior art include, for example, U.S. Pat. Nos. 4,497,485 to Macosko for a baseball pitching target; 5,083,774 to Yalvac for a baseball pitching target device; 5,333,856 to Gery for a pitching practice apparatus; 5,516,115 to McLain for a portable ball practice target; and 5,803,841 to Daskoski for a pitcher's training aid. None of these patents allow a pitcher to train with a catcher, as they are all designed to capture a ball thrown into the strike zone. Further, U.S. Pat. Nos. 5,348,291 to Scully for a ball pitching trainer and 5,704,855 to Kellogg, Jr. for a baseball pitching practice apparatus both define an open target area for pitching. Neither patent provides visual reinforcement of a central area of a strike zone to avoid when pitching.

U.S. Pat. No. 6,663,513 to Howard is directed towards a pitching practice device with adjustable strike zone indicator consisting of two adjustable poles extending vertically upward on a base slightly taller than home plate to provide optimum target area for a pitcher. Like other prior art devices, the target indicates areas that pitchers should throw a ball towards a hitter.

U.S. Pat. No. 4,473,227 to Klaus describes a pitchers' device to be used with a catcher and involves a frame split up in thirds to throw a ball through to a catcher. The Klaus device provides no suggestion to avoid a central portion of the strike zone, and in fact has a section through which a pitcher may throw the most hit pitch in the NO ZONE™ (NZ).

U.S. Pat. No. 7,175,550 to Bellah, Jr. et al. of discloses a training aid for pitchers and catchers designed to teach a pitcher to work the edges (inside and outside) of the plate. The device completely covers the traditional area of a conventional home plate and allows an unobstructed view from the pitcher to the catcher. However, the Bellah, Jr. device provides no visual guide vertically as to the dimensions of the strike zone, does not even remotely suggest teaching a pitcher to work the upper and lower regions of the strike zone, and cannot provide any training for those regions.

U.S. Pat. No. 6,695,725 to Burns, Jr. teaches a baseball hitting-pitching practicing device positionable in a batter's box for indicating a strike zone area. The Burns, Jr. device functions as a batter dummy and defines the strike zone only vertically. The Burns, Jr. device provides no suggestion of training a pitcher to aim for the periphery of a strike zone.

There continues to exist a need for practice pitching devices to assist pitchers to improve their pitching aim.

SUMMARY OF THE INVENTION

The present invention is directed towards a pitching practice device to hone the skill of the pitcher to seek the outer limits of the accepted strike zone. This area to avoid is defined as the NO ZONE™ area, or NO ZONE™ region, also referred to herein as "NZ".

In baseball and softball, the strike zone generally describes a rectangular area over home plate, forming a right angle pentagonal prism, extending from a batter's knee to the batter's armpit, as measured when the batter is in position at home plate. The home plate is traditionally 17 inches wide. The diameter of a baseball is from about 2.86 inches to about 2.94 inches, while the diameter of a softball is from about 3.5 inches to about 3.8 inches.

The NO ZONE™ region is defined as a subsection of the strike zone, including about the middle 11 to 13 inches of home plate, and generally ranging from about just above a batter's knee to the batter's hip. Typically when the batter is at home plate about to hit a ball, this NO ZONE™ region equates to about the middle of the thigh to the belly button region, or about the waist, of the batter. The device is adjustable in height such that the lowest portion of the device (either the end of protrusions, such as bristles, hanging vertically from a bar, or the bar which holds protrusions, such as bristles, upright) is generally at least 24 inches above the ground. When looking at the Figures, the NO ZONE™ area is the bristle area where the pitcher is to avoid throwing the ball. The present device trains a pitcher to aim the ball horizontally at a 2 inch region on either side of the center 13 inches of the plate, optionally including a 6 inch region between the plate and a batter's box chalk line. This typically corresponds to an area eight inches wide on either side of the device. Vertically, the device trains a pitcher to aim at an area from the waist to the armpit of a batter, or at an area slightly below the knee.

It is well known to one of skill in the art that pitchers should avoid throwing the ball towards the center of home base and outward from the center about 6 to 6.5 inches from the center, or essentially avoid the middle 13 inches of the home plate, and aim the ball for the outer edges of home plate. This device is directed towards encouraging the pitcher to aim the ball towards these outer edges in both vertical and horizontal directions.

The present invention comprises:

abase having a width at least as great as a simulated strike zone width, or equal to or greater than about 11 inches wide;

at least one adjustable post extending vertically upward from the base and at least 24 inches from the ground at its lowest point, and supported only by the base, the post being taller than a simulated strike zone height. If two posts are used, they can be separated by a lateral distance approximating the simulated strike zone width. The area can be devoid of structure between the posts or inside the simulated strike zone, or it can have some type of flexible enclosure allowing a ball to go through the enclosure; and attached to the post is a bar supported in a perpendicular position and holding a flexible structure like a netting, enclosure, or bristle-like object having sufficient strength to stand upward, or hang downward and allow a ball to go through the structure. The flexible structure can be made from any type of flexible material such as broom bristles, plastic, palmyra, nylon, Tampico, twigs, and the like, woven together to form a wall-like structure. The wall like structure can be standing upward, or hanging downward to define a longitudinal section of about 11 inches wide.

Generally, the inventive device may be positioned such that the flexible structure is supported above a location ranging from the back of home plate to a location about four feet forward of the front edge of home plate. The position may vary, for example, based upon training for an anticipated change in batter's position or for an alternative pitch type. Preferably, the device is placed at the front edge of home plate.

Other aspects and advantages of the present invention are described in the detailed description below and in the claims.

DESCRIPTION OF THE DRAWINGS

The invention is described in detail below with reference to the appended drawings. In the Figures.

DETAILS OF THE INVENTION

Figure 1:
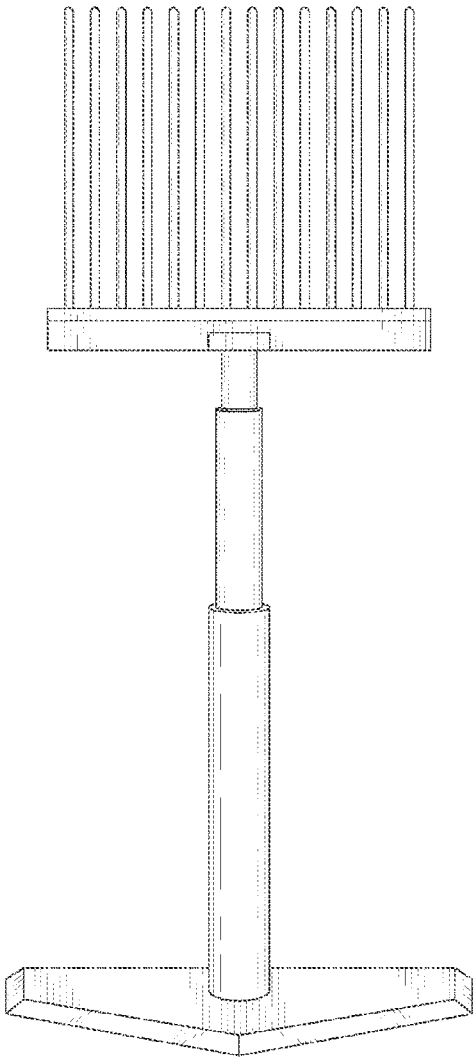
FIG. 1 illustrates a rearward perspective view (front view similar) of the NO ZONE™ device.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

The present invention is directed to a pitching practice device for indicating and simulating the height and width of a strike zone for a typical batter. It is a simple and inexpensive pitching practice device useful for indicating the boundaries of a detrimental region of a typical strike zone to softball and baseball pitchers. More particularly, this invention relates to a pitching practice device having an indicator that can be conveniently adjusted to simulate the adverse region of strike zones of batters of various heights. Unlike other devices on the market, the present inventive device is directed to show the pitcher the area to avoid throwing the ball.

The problem to which this invention is directed is the avoidance of the "NO ZONE™" (also written as "NZ"). The NZ is not the entire strike zone. As used herein, the NZ is defined horizontally as the middle 13 inches of home plate. Typically when the batter is at home plate about to hit a ball, this NO ZONE™ region is defined vertically to as a region extending from about the middle of the thigh to the belly button region, or about the waist, of the batter. So the device is adjustable in height such that the lowest portion of the device (either the end of the bristles hanging or the bar which holds the bristles upright) is at least 24 inches above the ground. It is the area of the strike zone that all pitchers need to avoid. It is the area above the plate that statistics have shown result in a higher degree of success for the hitter to reach base from a batted ball.

As used herein, the front edge of home plate refers to the edge of a home plate facing the center of a baseball diamond. The middle 13 inches of home plate refers herein to a 13-inch distance centered along the front edge of home plate.

The NZ device is designed to be placed at the front of home plate, or within about 2 inches of the front of home plate, so that the use of a catcher in live throwing practice is optimal. It is a device that blocks the center of the strike zone while leaving approximately the upper, lower, and the inner and outer (i.e., left and right) regions of the strike zone exposed. The device is designed to have the ball penetrate through it, should it be hit, and still allow the catcher to receive the ball. This gives the pitcher game-like practice and instant visual feed back in relation to where her/his pitch crosses the plate to the catcher's glove. The device also allows simultaneous training of the catcher. The NZ is meant to be avoided to hit 'spots' to which the catcher is set up behind the plate. If the ball hits the NZ, the pitcher knows that the probability of that pitch being struck by the hitter is higher than if the pitch avoids the apparatus and the ball hits the catcher's glove.

Major League Baseball keeps an extensive database of the performances of their professional ball players on a pitch-by-pitch basis. If a pitcher can avoid the NO ZONE™ area and still pitch to the upper, lower, inner and outer regions of the strike zone, the pitcher will be more successful. See, for example, paragraphs [0030] and [0092]-[0093] of United States Patent Application Publication 2010/0298958 to Connelly. Analysis of Major League Baseball statistics taken over a two year span in the late 90's has verified this relationship. See David Appelman, "Generalities in Pitch Location", Designated Hitter; Baseball Analysts, Rich Lederer & Friends, Nov. 2, 2006 [online], [retrieved from the Internet on Sep. 6, 2011]. The statistics proved that a majority of pitchers got hit for a substantial higher batting average against (or BAA, calculated as hits/[total batters faced—hit batters—walks—sacrifice hits allowed—sacrifice flies allowed]) and a higher earned runs average against when a pitch crosses the middle of the plate. A pitcher may choose to do so because the pitcher was behind in the count (i.e., has fewer strikes than balls against a batter at-bat) as well as for other reasons. In other words, when a pitcher needed to throw a strike to the NZ, the ball was hit for a higher percentage of base hits than any other contact point on the plate within the strike zone.

As a college softball coach, I have used The NO ZONE™ inventive device for a semester after a dismal previous semester in terms of performance from our pitching staff. The results were improved pitching accuracy; i.e., a 1.5 run difference in our team/staff earned run average ("ERA"). The Earned Run Average went from a 3.8 team ERA to a 2.33 team ERA. That is a substantial difference which resulted in increased pitcher confidence and more wins for our team.

The NO ZONE™ device is different than apparatuses currently on the market in that its main purpose is to train a pitcher to avoid hitting the device, and thereby train a pitcher to avoid a hitter's high-success areas. See, for example, page 62 of Schutt Sports 2012 Softball Baseball Catalog (© 2011 Schutt Sports Inc., 710 Industrial Dr., Litchfield, Ill. 62056)

and pages 7, 9 and 10 of Home Run Sports 2008 Baseball/Softball Catalogue (2008 Home Run Sports, 1005 St Mary's Road, Winnepeg, Manitoba R2M3S4). The device may further be used with a catcher to give instant visual feedback for success. Other apparatuses found in the prior art involve targets meant to be hit.

Most of the devices on the market and in catalogs are canvas, or the like, catching apparatuses intended to be used without a catcher. The present invention can be used with or without a catcher. The inventive device allows the pitcher to develop an accurate understanding of where or how a pitch may be manipulated through the strike zone by changing the position of the device in front of or behind home plate.

The NO ZONE™ inventive device provides a pitcher a visual cue identifying a zone to avoid at the front of the plate when throwing the ball. It gives game-like practice by using a catcher and in turn creates a 3 dimensional view of the region to which the pitcher needs to direct the ball to reduce hitter success while still hitting the strike zone. In contrast, a conventional target cannot be positioned both in front of and behind the plate and cannot simultaneously train both the pitcher and the catcher.

The device is described in reference to bristles of a certain type of exemplary material, hut it can be made of any material that allows the ball to pass through it and is sufficiently resilient to return to its original shape. Preferably, the material allows a catcher receiving the ball to detect the ball through the entirety of its flight. If hanging downward, the material may even comprise cloth-like strings or the like.

Figure 2:
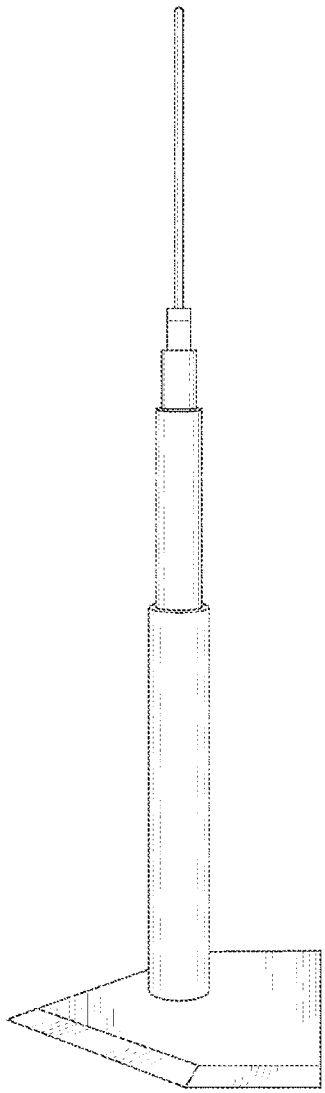
FIG. 2 illustrates a side perspective view of the device.
Figure 3:
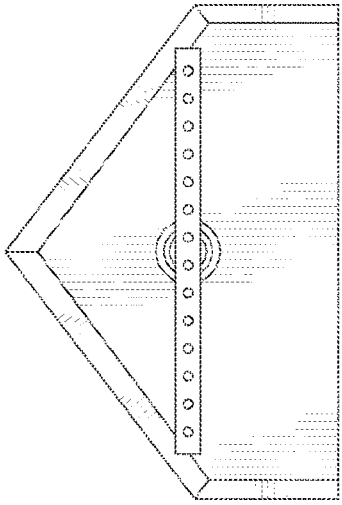
FIG. 3 illustrates a top view of the device.
Figure 4:
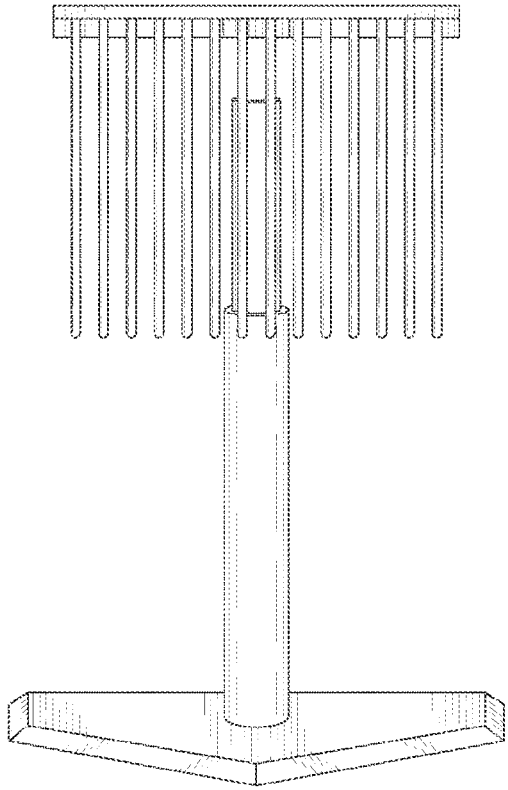
FIG. 4 illustrates a rearward perspective view (front view similar) of an alternative embodiment of the NO ZONE™ device wherein the bristles hang downward.
Figure 5:
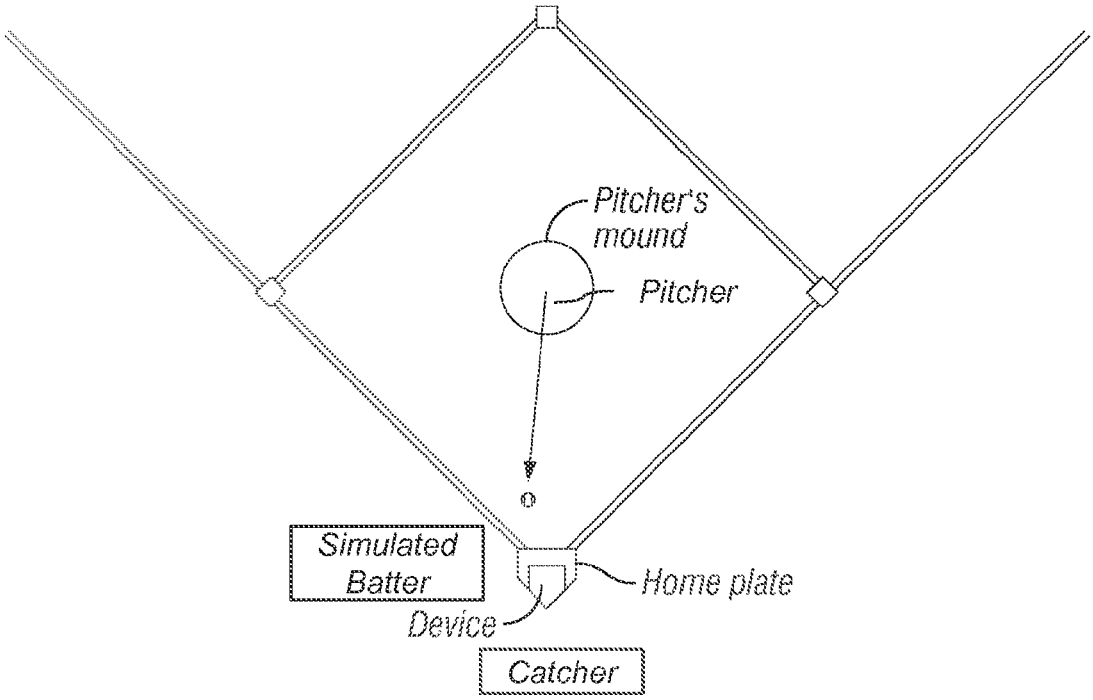
FIG. 5 is a schematic illustration positioning the NO ZONE™ device in proximity to home plate at a distance from the pitcher's mound and demonstrating where a ball might be aimed.

FIGS. 1-4 illustrate an embodiment of the invention. FIG. 1 illustrates a rearward perspective view of the inventive device (front view similar). FIG. 2 illustrates a side perspective view of the device. FIG. 3 illustrates atop view of the device. FIG. 4 illustrates an alternative embodiment of the NO ZONE™ device, providing a rearward perspective view wherein the bristles hang downward.

The present invention generally comprises:

a base having a width at least as great as a simulated strike zone avoidance area width, or about 11 inches to about 20 inches wide;

at least one adjustable post extending vertically upward from the base such that the upper end reaches at least the lower end of a simulated strike zone, such as at least 24 inches from the ground at its lowest adjustment, and is supported only by the base. If two posts are used, they can be separated by a lateral distance approximating the simulated strike zone width. The area can be devoid of structure between the posts inside the simulated strike zone, or it can have some type of flexible enclosure allowing a ball to go through the enclosure; and attached to the post is a bar supported in a perpendicular position and holding a flexible structure like a netting, enclosure, or bristle-like object having sufficient strength or stiffness to stand upward, or hang downward, and allow a ball to go through the structure. The flexible structure can be made from any type of flexible material such as broom bristles, plastic, palmyra, nylon, Tampico, twigs, rubber, and the like, placed closely together to form a wall-like structure. The wall like structure can be standing upward, or hanging downward to define a longitudinal section of about 13 inches wide.

The perpendicular bar can be made of plastic (for example, polyvinyl chloride [PVC], metal, wood, or other light weight material which can suitably hold the bristle-like structure described herein.

In one embodiment, the device comprises a plurality of parallel, linear projections secured perpendicularly to a bar or plank, which is adjustably suspended by a suspending means such that the projections extend vertically having a length of from about 10 inches to about 20 inches, and such that the projections are horizontally centered with respect to a home plate, as determined along a position parallel to the front edge of home plate. The suspending means may suspend the device from below and be an adjustable leg, stand, or the like, or may suspend the device from above and be an overhead rope, beam, or the like. The projections are secured across a section of the bar or plank measuring about 10 to 15 inches. Generally, the projections are permeable to a ball, for example, by bending upon contact. The projections are also typically made of a material and/or positioned such that an approaching ball may be seen through the device. These features provide for improved safety for both the pitcher and the catcher in that a ball will travel a predictable path rather than bounce off the device or be captured by the device, and will be visible throughout the flight path, reducing the possibility of hitting a player.

A prototype of the inventive device was made using bristles from a street cleaning broom glued onto a base (the bar held perpendicular to the adjustable pole attached to the base). Together the bristles were found to be stiff or firm enough to stand upright. If the bristles are hanging downward, they can be of any material such as rope, string, nylon, foam, or rubber, or any material that allows the ball to penetrate through the device or between its elements. It is not recommended that they be made of materials that may catch the ball, since this will interfere with catcher training and prevent the pitcher from fully recognizing the track the ball may follow.

The inventive device has at least the following properties:

1. An adjustable stem (leg) that can be moved up or down based on the size of a simulated hitter of the selected age group;
2. The bristles are suspended at least 24 inches off the ground at their lowest point, or at least as high as the bottom of the simulated strike zone;
3. The bristles are either suspended downward or are made from materials that are firm enough to stand upright on their own but sufficiently permeable or flexible for the ball to penetrate through the device; and
4. The bristles are distributed along approximately 11-13 inches. The plate is 17 inches wide. This allows a pitcher to pitch to the strike zone outside the NO ZONE™ area by aiming pitches outside of the edges of the device.

The bristles are long enough to extend the distance from the belly button to knees of a simulated hitter. This allows a pitcher to aim within the strike zone at a position from belly button to sternum or the lower portions of the knees. The inventive device provides a simple and portable, yet effective, way to train a pitcher to "paint the corners" of the strike zone (i.e., to throw pitches at the edges of the strike zone).

EXAMPLES

Three Division 1 college softball pitchers were trained to determine the performance of the prototype inventive device. Players, A, B and C vary in height from about 5'6" to about 6' tall. Comparative data was taken from the last 100 days (about 3 months) of our Spring season (before using the NO ZONE™ device; no pitching aids were used) and 100 days of our Fall ball season (after training with the NO ZONE™ device). During each season, the pitchers each played approximately 50 innings. The level of play is comparable in both seasons. Data regarding these innings was used to compare each player's success while training with the NO ZONE™ device to the base data collected during the spring.

During spring practice, each pitcher practiced pitching for a continuous period of about 40 minutes about 2 to 3 times per week. During the fall season, each pitcher used the NO ZONE™ device about 2-3 times per week, for 40 minutes of continual pitching. The data collected during games played in each season are presented in Table 1, below.

TABLE 1

Data indicating 3 players and their improvement in ERA

| Player | Season | Innings Pitched | Earned Runs | Runs Against | Strike-outs | Walks | Earned Run Average |
|---|---|---|---|---|---|---|---|
| A | Spring | 60 | 30 | 32 | 30 | 20 | 3.50 |
| A | Fall | 50 | 14 | 18 | 30 | 18 | 1.96 |
| B | Spring | 58 | 38 | 42 | 29 | 53 | 4.58 |
| B | Fall | 40 | 17 | 18 | 16 | 21 | 2.95 |
| C | Spring | 40 | 22 | 30 | 10 | 15 | 3.85 |
| C | Fall | 40 | 14 | 18 | 30 | 18 | 2.45 |

Players: A & B = 5' 6" tall. C = 6' tall.

Earned runs are divided by innings pitched to obtain the ERA. The ER is generally calculated using 7 innings for softball; 9 innings are generally used in calculating ERA for baseball. Surprisingly, as shown in the Table above, the Earned Run Average (ERA) of all three players decreased by about 1.5 runs per game! The data also shows a consistent increase in the strikeout to walk ratio. According to this data, the NO ZONE™ device effectively improves a pitcher's pitching skills.

The above example of the NO ZONE™ inventive device illustrates a decrease in the runs pitchers gave up and also improved statistics evaluated by those of skill in the art, in particular the strikeout to walk ratio, as compared to pitching practice without a training device.

There is thus provided in accordance with the present invention a pitching practice device comprising a securing member having a width of about 10 to about 15 inches; a permeable region fastened to the securing member having a width about equal to the securing member and a length of about 5 to about 20 inches; and a means of supporting the permeable region and securing member in an adjustable position proximate to a home plate. The device comprises materials selected and assembled such that a ball may penetrate the permeable region without permanently deforming the device and the ball is not captured by the device.

The permeable region generally comprises a plurality of projections fastened perpendicularly to the securing member, each having a length of about 5 to about 20 inches. The number, spacing, and material of the projections is selected such that when a ball approaches a first side of a planar area of the device defined by the width of the securing member and the length of the projections, the ball is at least partially visible on the side of the device opposite that of the approaching ball and a ball may penetrate the planar area of the device without permanently deforming the device.

Typically, the length of the projections is about the same as the width of the securing member. Preferably, the securing member has a width of about 13 inches. In one embodiment, the means of supporting the permeable region and securing member comprises at least one post. Generally, the device is positionable such that the lowest point of the securing member and the permeable region is at least about 24 inches above ground level.

A pitching practice method is also provided in accordance with the invention. In this method, a device is provided comprising a plurality of protections fastened perpendicularly to a securing member. The device is generally positioned above a home plate parallel to a front edge of the home plate. Horizontally, the device is typically positioned from the rear of the home plate to about four feet from the front of the home plate such that the device is centered between two parallel edges of the home plate. Preferably, the device is positioned horizontally at the front edge of the home plate. In most cases, the horizontal position of the device is adjusted to enable enhanced training for a particular pitch or a particular anticipated batter. Vertically, the device is typically such that the lowest part of the device is at least as high as knee level of a simulated batter. Preferably, the lowest part of the device is positioned at a height of at least 20 inches.

According to the inventive method, a pitcher is positioned at a pitcher's mound. Preferably, a catcher is positioned behind the home plate. The pitcher pitches at least one ball aimed at a location at the periphery of the device. Generally, horizontally, the ball is aimed at a region comprising from an edge of the device to about 8 inches from the device on either side; and vertically, the ball is aimed at a region selected from about the bottom of the device to about 10 inches below the device and from the top of the device to about 10 inches above the device.

In one embodiment, a device is provided for simultaneously training a pitcher and catcher to direct pitches to the periphery of a strike zone. In this embodiment, the device comprises a base having a width of at least about 11 inches wide; at least one adjustable post extending vertically upward from the base to at least 24 inches from the ground at its upper point, and supported by the base; and a bar attached to the post in a perpendicular position and holding a flexible bristle-like structure. The bristle-like structure is suspended vertically either downward or upward.

Generally, the bristle-like structure comprises a material selected from the group consisting of plastic, palmyra, nylon, Tampico, twigs, and fabric, positioned in close proximity to form a wall-like, broom-like structure of no greater than about 13 inches wide. Typically, the bar comprises a lightweight, rigid material selected from the group consisting of a natural polymer, a synthetic polymer, a metal, a metallic alloy, wood, a reinforced fibrous material, and bamboo.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A pitching practice device comprising:

(i) a securing member having a width of substantially that of a home plate;

(ii) a permeable region fastened to the securing member having a width about equal to the securing member, wherein the permeable region comprises a plurality of upwardly directed projections fastened perpendicularly to the securing member, each having a length ranging from about 5 to about 20 inches, wherein the plurality of projections form a barrier which substantially covers the length of the securing member, and wherein the number, spacing, and material of the projections is selected such that when a ball approaches a first side of a planar area of the device defined by the width of the securing member and the length of the projections, the ball is partially visible on the side of the device opposite that of the approaching ball;

(iii) a means for adjustably supporting the permeable region and the securing member; and, (iv) wherein further the number, spacing, and material of the projections is selected such that a ball penetrates the planar area of the device without permanently deforming the device.

2. The pitching practice device of claim 1, wherein the permeable region and securing member are supported by at least one post.

3. A pitching practice method comprising:

(i) providing a device comprising a securing member having a width of substantially that of a home plate, a permeable region fastened to the securing member having a width about equal to the securing member, wherein the permeable region comprises a plurality of upwardly directed projections fastened perpendicularly to the securing member, each having a length ranging from about 5 to about 20 inches, wherein the plurality of projections form a barrier which substantially covers the length of the securing member, and wherein the number, spacing, and material of the projections is selected such that when a ball approaches a first side of a planar area of the device defined by the width of the securing member and the length of the projections, the ball is partially visible on the side of the device opposite that of the approaching ball;

(ii) positioning the device above the home plate parallel to a front edge of the home plate in a horizontal position ranging from the rear of the home plate to about four feet from the front of the home plate such that the device is centered between two parallel edges of the home plate;

(iii) positioning the device vertically such that the lowest part of the device is at least as high as knee level of a simulated batter;

(iv) positioning a pitcher at a pitcher's mound and optionally a catcher behind the home plate; and (v) pitching at least one ball aimed at a location at the periphery of the strike zone, and wherein the at least one ball is not captured by the device and penetrates the permeable region without permanently deforming the device, and wherein the permeable region corresponds to a central portion of the strike zone and simultaneously trains the pitcher and catcher to direct pitches to the periphery of the strike zone by avoiding pitches towards the permeable region.

4. The pitching practice method of claim 3, wherein the device is positioned horizontally at the front edge of the home plate.

5. The pitching practice method of claim 3, wherein the horizontal position of the device is adjusted to enable enhanced training for a particular pitch or a particular anticipated batter.

6. The pitching practice method of claim 3, wherein the device is positioned vertically at a height of at least 20 inches.

7. The pitching practice method of claim 3, wherein the ball is aimed horizontally at a region comprising from an edge of the device to about 8 inches from the device on either side.

8. The pitching practice method of claim 3, wherein the ball is aimed vertically at a region selected from about the bottom of the device to 10 inches below the device and from the top of the device to 10 inches above the device.

9. A device for simultaneously training a pitcher and catcher to direct pitches to the periphery of a strike zone comprising:

a base having a width of at least 11 inches;

at least one adjustable post extending vertically upward from the base to at least 24 inches from the ground, and supported by the base;

a bar attached to the post in a perpendicular position and having a width of substantially that of a home plate;

a flexible bristle structure fastened perpendicularly to the bar and having a width equal to the width of the bar and a length ranging from about 5 to about 20 inches, wherein the bristle structure is suspended vertically upward and includes a plurality of bristles, wherein the plurality of bristles form a barrier which substantially covers the length of the securing member, and wherein the bristle structure comprises a material selected from the group consisting of plastic, palmyra, nylon, Tampico, twigs, and fabric, positioned in close proximity to form a broom structure, and wherein a ball is not captured by the device and penetrates the bristle structure without permanently deforming the device, and wherein the bristle structure corresponds to a central portion of a strike zone and simultaneously trains a pitcher and catcher to direct pitches to the periphery of the strike zone by avoiding pitches towards the bristle structure.

10. The device of claim 9, wherein the bar comprises a light-weight, rigid material selected from the group consisting of a natural polymer, a synthetic polymer, a metal, a metallic alloy, wood, a reinforced fibrous material, and bamboo.

* * * * *